US011160702B2

(12) United States Patent
Horacek

(10) Patent No.: US 11,160,702 B2
(45) Date of Patent: Nov. 2, 2021

(54) RIGID FRAME WHEELCHAIR

(71) Applicant: Gregor Horacek, Ransbach-Baumbach (DE)

(72) Inventor: Gregor Horacek, Ransbach-Baumbach (DE)

( * ) Notice: Subject to any disclaimer, the term of this patent is extended or adjusted under 35 U.S.C. 154(b) by 358 days.

(21) Appl. No.: 16/373,438

(22) Filed: Apr. 2, 2019

(65) Prior Publication Data

US 2019/0314228 A1 Oct. 17, 2019

(30) Foreign Application Priority Data

Apr. 17, 2018 (EP) ..... 18167665

(51) Int. Cl.
*A61G 5/08* (2006.01)
*A61G 5/10* (2006.01)
*A61G 5/12* (2006.01)

(52) U.S. Cl.
CPC ..... *A61G 5/0891* (2016.11); *A61G 5/1054* (2016.11); *A61G 5/1059* (2013.01); *A61G 5/1075* (2013.01); *A61G 5/128* (2016.11)

(58) Field of Classification Search
CPC .... A61G 5/0891; A61G 5/1054; A61G 5/128; A61G 5/1059; A61G 5/1075
See application file for complete search history.

(56) References Cited

U.S. PATENT DOCUMENTS 5,020,816 A 6/1991 Mulholland
5,727,802 A 3/1998 Garven, Jr. et al.
6,241,275 B1 * 6/2001 Slagerman ..... A61G 5/08 280/650
6,264,225 B1 * 7/2001 Kunishige ..... A61G 5/1059 280/250.1
7,891,696 B2 * 2/2011 Hanson ..... A61G 5/085 280/647
8,186,695 B2 * 5/2012 Moller ..... A61G 5/107 280/47.4
2005/0168033 A1 * 8/2005 Peterson ..... A61G 5/10 297/337

FOREIGN PATENT DOCUMENTS

DE 299 01 471 U1 7/1999
DE 102 48 624 A1 5/2004
WO 2005067857 A1 7/2005

* cited by examiner

*Primary Examiner* — Kevin Hurley
*Assistant Examiner* — Harold Eric Pahlck, III
(74) *Attorney, Agent, or Firm* — Christopher C. Dremann, P.C.; Christopher C. Dremann

(57) ABSTRACT

A rigid frame wheelchair of a box frame design includes a base frame having a rear axle for receiving rear wheels and a left-hand side strut and a right-hand side strut for receiving steering wheels, an L-shaped seat-foot support frame having an L-shaped left-hand strut and an L-shaped right-hand strut, two coupling units that connect together in an articulated manner the base frame to the seat-foot support frame about an axis vertically to a sagittal plane for an angular adjustment, a left-hand frame connector and a right-hand frame connector that fixedly connect together the base frame and seat tube segments of the L-shaped struts.

12 Claims, 9 Drawing Sheets

RIGID FRAME WHEELCHAIR

FIELD OF THE INVENTION

The invention relates to a rigid frame wheelchair which is designed according to the box frame design.

BACKGROUND AND RELATED ART

The following specifications relating to the front, rear, right, left, top, bottom and sagittal plane are to be understood from the background of a person seated on the wheelchair and the specifications relating to the vertical, horizontal and perpendicular are also to be understood when arranging the wheelchair on a horizontal substrate.

Rigid frame wheelchairs are sufficiently well known from the prior art. They are used where the main priority is placed on low weight, stiffness and maximum maneuverability.

Said wheelchairs are so-called active wheelchairs with specific options for adjustment and/or individual options for adaptation for active users (in contrast to passive users—pushed by an accompanying person) and differ substantially by two designs: the open frame design and the box frame design.

In the open frame design, the frame (without a rear frame) consists of an L-shaped seat-foot support frame—with a seat frame segment and foot support frame segment—and a rear axle construction welded to the seat frame segment (individual construction) or adjustably fastened (adaptable). The advantages of this design are in the low weight and the space-saving accommodation (with the rear wheels/drive wheels removed) for transport, since the L-shaped frame requires little space and may be inserted easily between other items of luggage in the trunk.

Examples of an open frame design are wheelchairs disclosed hereinafter:

- Helium Pro from the firm Sunrise Medical as an individual (welded) variant described on the website sunrisemedical.de.
- Argon from the firm Sunrise Medical as an adaptable variant described on the website sunrisemedical.de.
- ZR from the firm Permobil as an individual (welded) variant described on the website permobilus.com.
- ZRA from the firm Permobil as an adaptable variant described on the website permobilus.com.

In the box frame design, an additional frame connection from the rear axle to the foot support frame segment is provided in the region of the steering wheels. All of the frame parts are rigidly connected together.

The advantage of the box frame design is in the greater level of stiffness in comparison with the open frame design.

Examples of a box frame design are the wheelchairs disclosed hereinafter:

- Easy Life R from the firm Sunrise Medical described on the website sunrisemedical.de.
- TR from the firm Permobil as an individual (welded) variant with a fixed seat height and fixed seat angle but with a longitudinally adjustable rear axle for adjusting the active level described on the website permobilus-.com.
- TRA from the firm Permobil as an adaptable variant (seat height, seat angle, active level) described on the website permobilus.com.
- SPEEDY 4TEEN from the firm PROACTIV as an adaptable variant (seat height, seat angle, active level) described on the website proactive-gmbh.de.

In the case of the adaptable variant, the steering forks are fastened to the frame so as to be adjustable in terms of angle, so that the rotational axis thereof may always be oriented relative to the perpendicular and/or vertical irrespective of the adjusted seat angle. This is essential for avoiding "wobbling" of the steering wheels. For adjusting the seat angle (or even the rear seat height) the spacing of the rear axle to the seat tube is adjusted. The closer the rear axle is positioned to the seat tube, the greater the seat angle with a given seat height. For installing rear wheels with camber, the camber adapter is rotatably installed in the rear axle tube or in the rear wheel receiver. This permits the adjustment of the camber of the rear wheels when altering the seat angle. The adjustment of the camber is also essential for running the rear wheels with low friction.

The following embodiments refer to the box frame design, in particular with an adaptable frame, such as for example TRA from Permobil or SPEEDY 4TEEN from PROACTIV. Apart from the seat width and seat depth, the essential adapting and/or adjusting parameters of an active wheelchair are:

- the seat height
- the seat angle
- the active level or even the center of gravity The relative position—from the lateral view—of the rear axle (drive wheels) to the back is understood here.

The further the rear axle is positioned away from the back to the front—in the direction of travel—the more active the adjustment and/or the closer it is located below the center of gravity of the wheelchair/user system. The wheelchair is thus very maneuverable but at the same time the risk of rollover is increased. A very active adjustment is reserved only for experienced wheelchair users.

The closer the rear axle is positioned relative to, or even behind, the backrest, the more stable the wheel chair is in terms of rollover but it is all the more cumbersome to move.

The adaptation of the seat height and the seat angle in the aforementioned box frame design in an adaptable variant is to be considered more closely.

For the approximate adaptation to different body sizes, most manufacturers provide 3-4 frame sizes. The adjustment of the exact seat height (with a given frame size) is implemented by the choice of steering forks of variable heights and by the positioning of the steering wheels in the steering forks at variable heights, and the adjustment of the seat angle (or rear seat height) by the adjustment of the spacing of the rear axle from the seat frame.

The following drawbacks have to be taken into account in this design:

- the requirement of using steering forks of variable heights increases the stock of manufacturers and specialist retailers
- with a retrospective seat height adaptation potentially new steering forks have to be provided and reinstalled.
- with an adjustment of the seat angle (by displacing the rear axle) the steering forks have to be re-adjusted to the perpendicular. If the rear wheels are installed with camber (as in most cases) the toe thereof has to be re-adjusted otherwise they produce a high level of friction and tire wear.

OBJECT AND SUMMARY OF THE INVENTION

It is the object of the present invention to provide a rigid frame wheelchair in an adaptable box frame design in which the adjustment of the seat height and the seat angle is able to be carried out with low material use and reduced operating effort.

The object is achieved by a rigid frame wheelchair which is configured according to the present invention, as described and shown herein.

In a rigid frame wheelchair according to the invention, the rigid shape of a box frame is achieved by fixedly welded frame parts and by separate frame parts which are adjustable to one another. A rigid frame wheelchair which is designed according to the box frame design is proposed with the following features:

- a base frame which has a rear axle for receiving rear wheels and a left-hand side strut and a right-hand side strut for receiving steering wheels in the front regions of the side struts,
- an L-shaped seat-foot support frame which has an L-shaped left-hand strut and an L-shaped right-hand strut, wherein the respective strut has a seat tube segment and a foot support tube segment, and the seat-foot support frame further has a transverse strut which connects the struts,
- two coupling units which connect together in an articulated manner the base frame in the left-hand and right-hand front region to the seat-foot support frame in the region of the left-hand and right-hand foot support tube segments thereof, about an axis vertically to a sagittal plane for an angular adjustment, and in which the foot support tube segments are adjustably mounted for a seat height adjustment,
- a left-hand frame connector and a right-hand frame connector, wherein the frame connectors fixedly connect together the base frame and the seat tube segments, wherein the seat tube segments are able to be connected to the frame connectors in various positions.

For achieving greater stability it is regarded as advantageous to install an additional movable transverse strut on the seat-foot support frame in the rear region of the seat tube segments, the left-hand and right-hand frame connectors preferably being able to be fastened to the lateral left-hand and right-hand end thereof.

Since in the construction thus described the base frame always has the same position relative to the road (spacing and angle), neither adjustment operations nor replacement measures which are susceptible to error should be required on the steering forks or on the rear wheels. The seat angle and the seat height are adjusted solely by rotating the seat-foot support frame with the coupling units (seat angle) and/or by displacing into the coupling units (seat height) and by fixing the seat tube segments to the left-hand and right-hand frame connectors.

In particular, the foot support tube segments in the adjusted displaced position thereof are fixedly connected to the coupling units. Additionally, it may be provided to block the joints after the angular adjustment of the foot support tube segments has been carried out.

Further features and advantages of the invention are described in the following detailed description and shown in the accompany drawing figures, which represent exemplary embodiments according to the invention.

BRIEF DESCRIPTION OF THE DRAWING FIGURES

The invention is described with reference to exemplary embodiments and shown in the accompanying drawing figures, without being limited thereto.

DETAILED DESCRIPTION OF EXEMPLARY EMBODIMENTS

Figure 1:
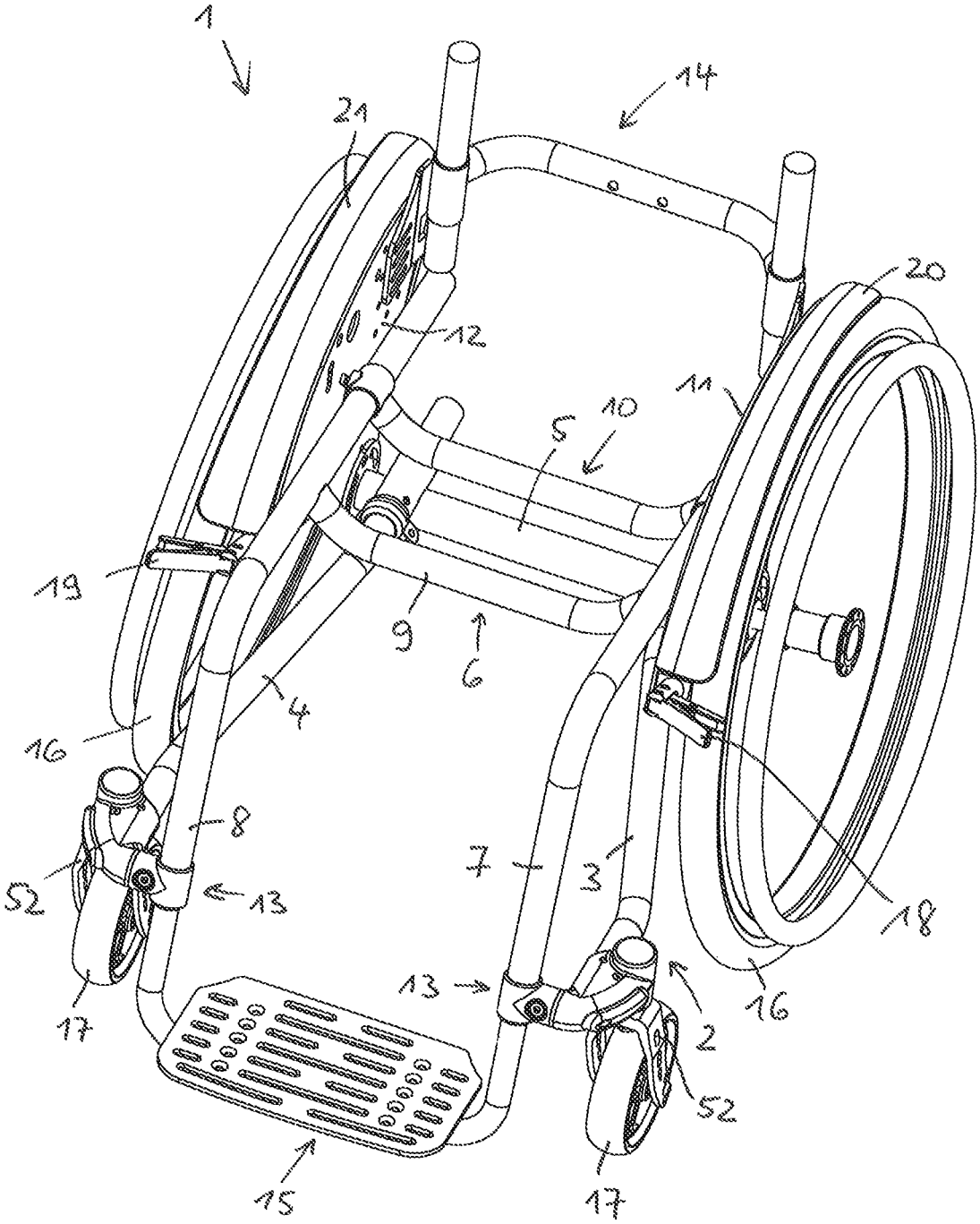
FIG. 1 shows in a three-dimensional view a wheelchair without the seat and backrest surfaces serving for receiving a person.

FIG. 1 shows a foldable wheelchair 1 without the seat and backrest surfaces which serve to receive a person.

As essential components, the wheelchair 1 has a base frame 2, a seat-foot support frame 6, a transverse strut 10, a left-hand frame connector 11 and a right-hand frame connector 12, coupling units 13, a backrest frame 14, a foot support 15, rear wheels 16, front wheels 17, a left-hand rear wheel brake 18 and a right-hand rear wheel brake 19 as well as a left-hand fender 20 and a right-hand fender 21 (FIG. 1).

Reference is made hereinafter to the view of FIGS. 2 to 13, which illustrate the essential components of the wheelchair and/or the individual components thereof for carrying out the adjustment to the seat angle and seat height of the wheelchair.

Figure 2:
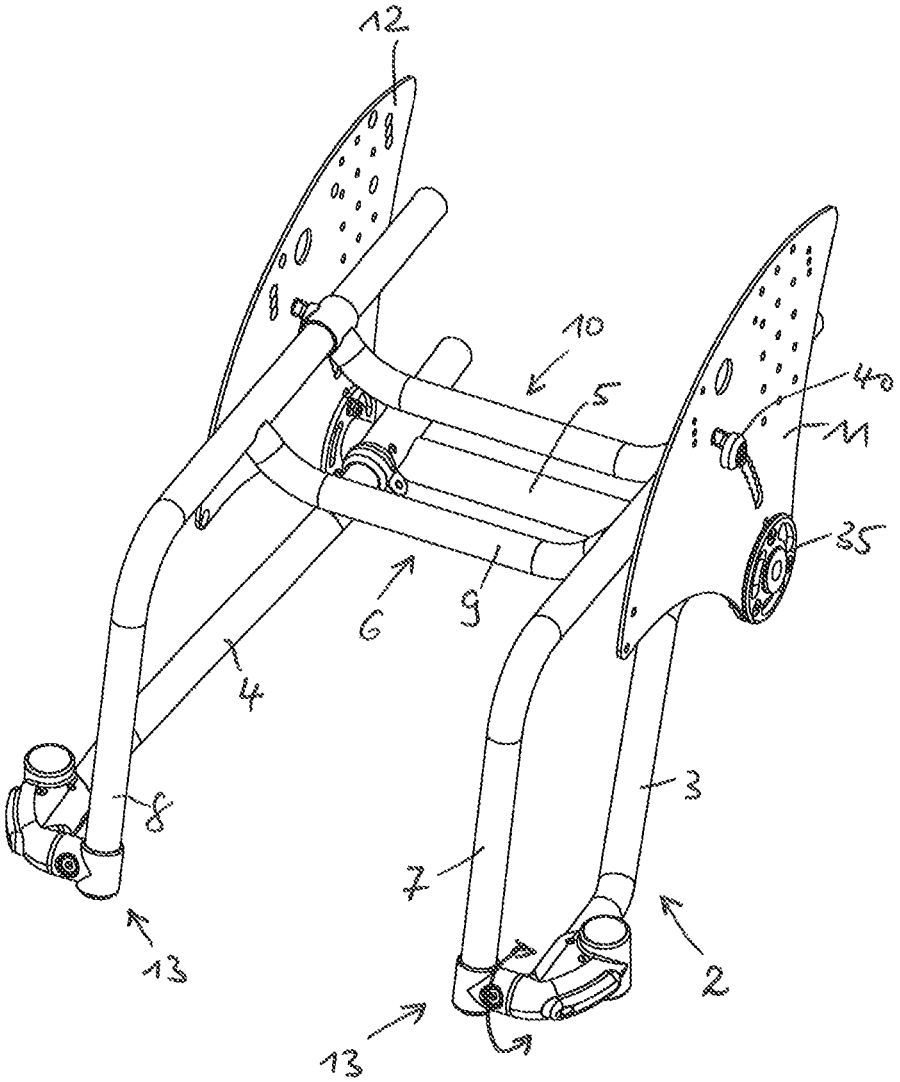
FIG. 2 shows in a three-dimensional view the wheelchair for a partial region which substantially relates to the base frame, the seat-foot support frame, the coupling units and the frame connector.
Figure 3:
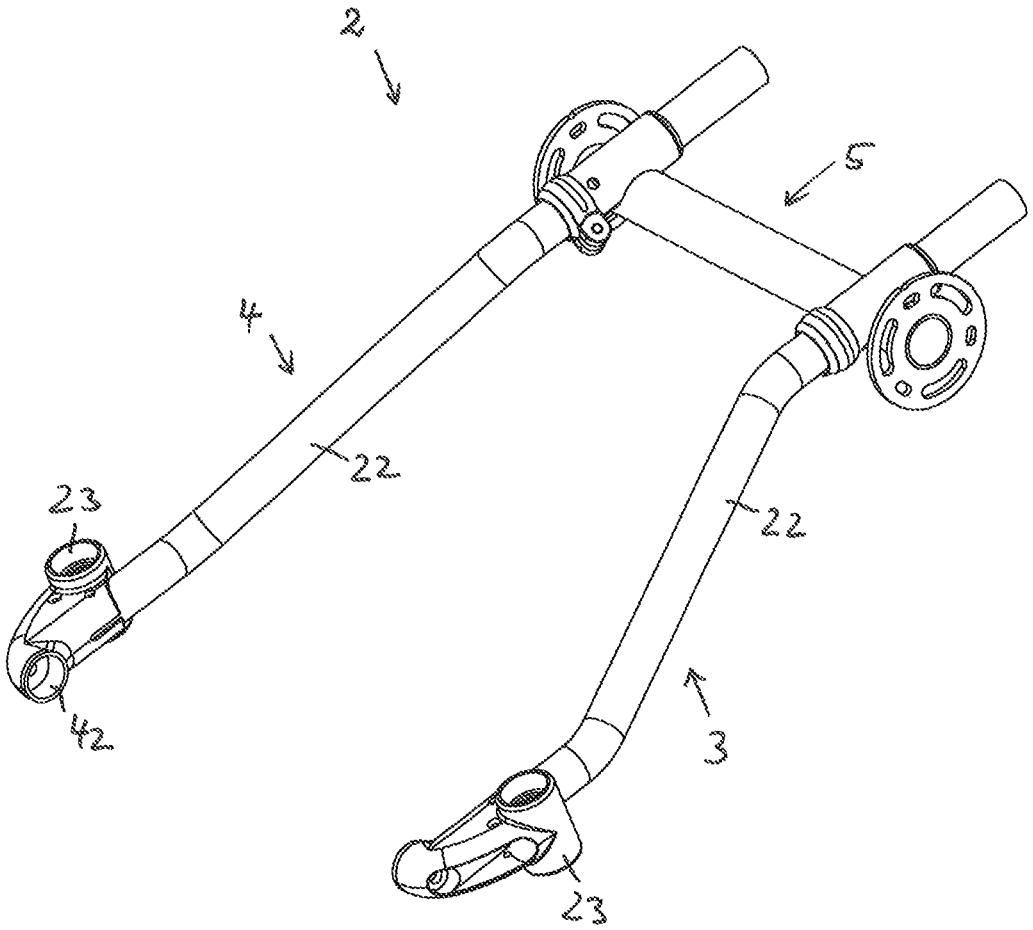
FIG. 3 shows in a three-dimensional view the region of the wheelchair which substantially relates to the base frame.
Figure 4:
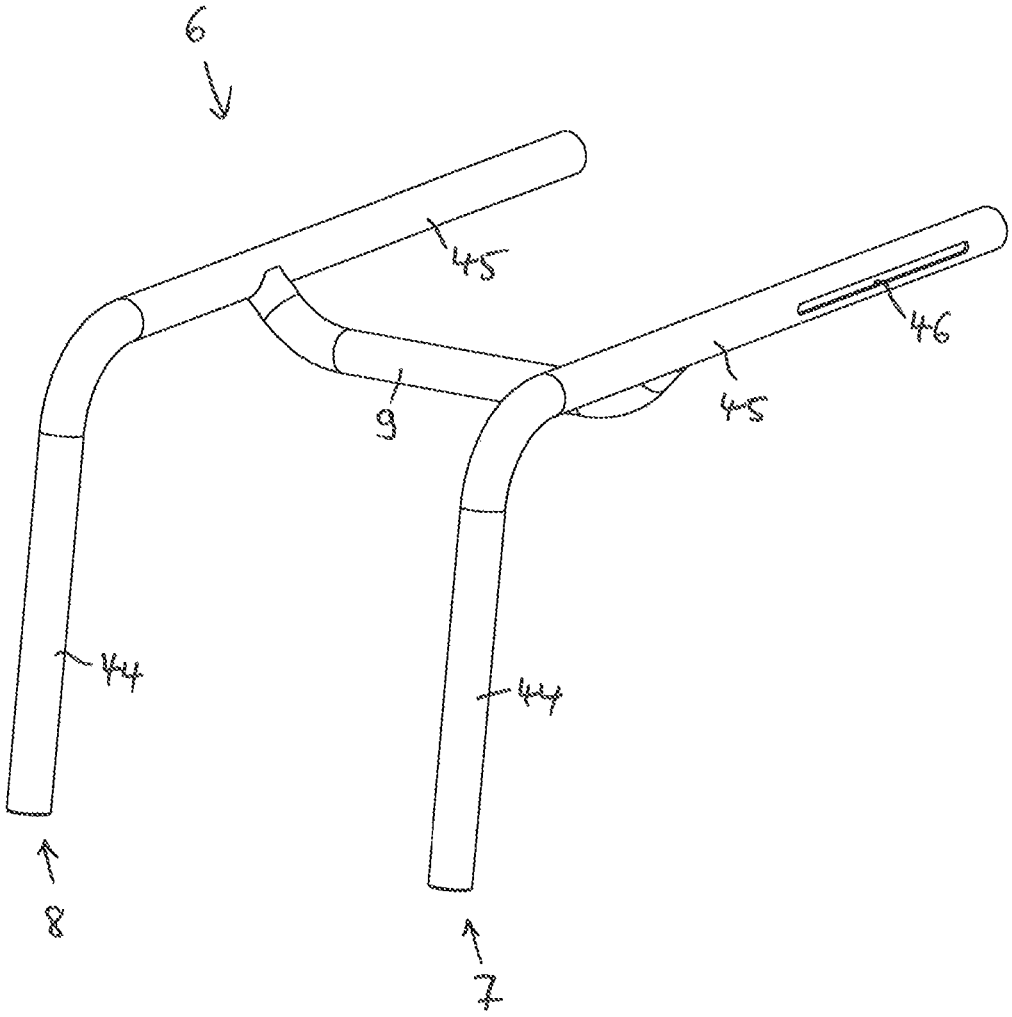
FIG. 4 shows in a three-dimensional view the region of the wheelchair which relates to the seat-foot support frame.

The base frame 2 (FIG. 3) consisting of the left-hand side strut 3, right-hand side strut 4 and rear axle 5 is connected in an articulated manner by means of coupling units 13, in each case consisting of (FIG. 5) the coupling piece 24, clamping element 25 and connecting elements 26, 27, 28, 29, 30, and 31, to the seat-foot support frame 6 about an axis vertically to the sagittal plane (FIG. 2). The embodiment shown here of the base frame 2 represents only one possible embodiment. Thus, in particular, the side struts 3 and 4, for example, could also be designed such that they respectively consist of a tubular bent part, the front tube portion thereof being perpendicular to the sagittal plane and directly receiving the coupling unit 13 in a rotatable and clampable manner. Separate steering fork receivers could be fastened to suitable tubular portions.

The rear axle 5 in the embodiment shown here is displaceable on the struts 3 and 4 for the adjustability of the wheelbase and is fixed by clamping. However, for example, the rear axle could also be fixedly welded directly to the side struts 3 and 4. The rear axle 5 is arranged perpendicular to the sagittal plane.

Figure 5:
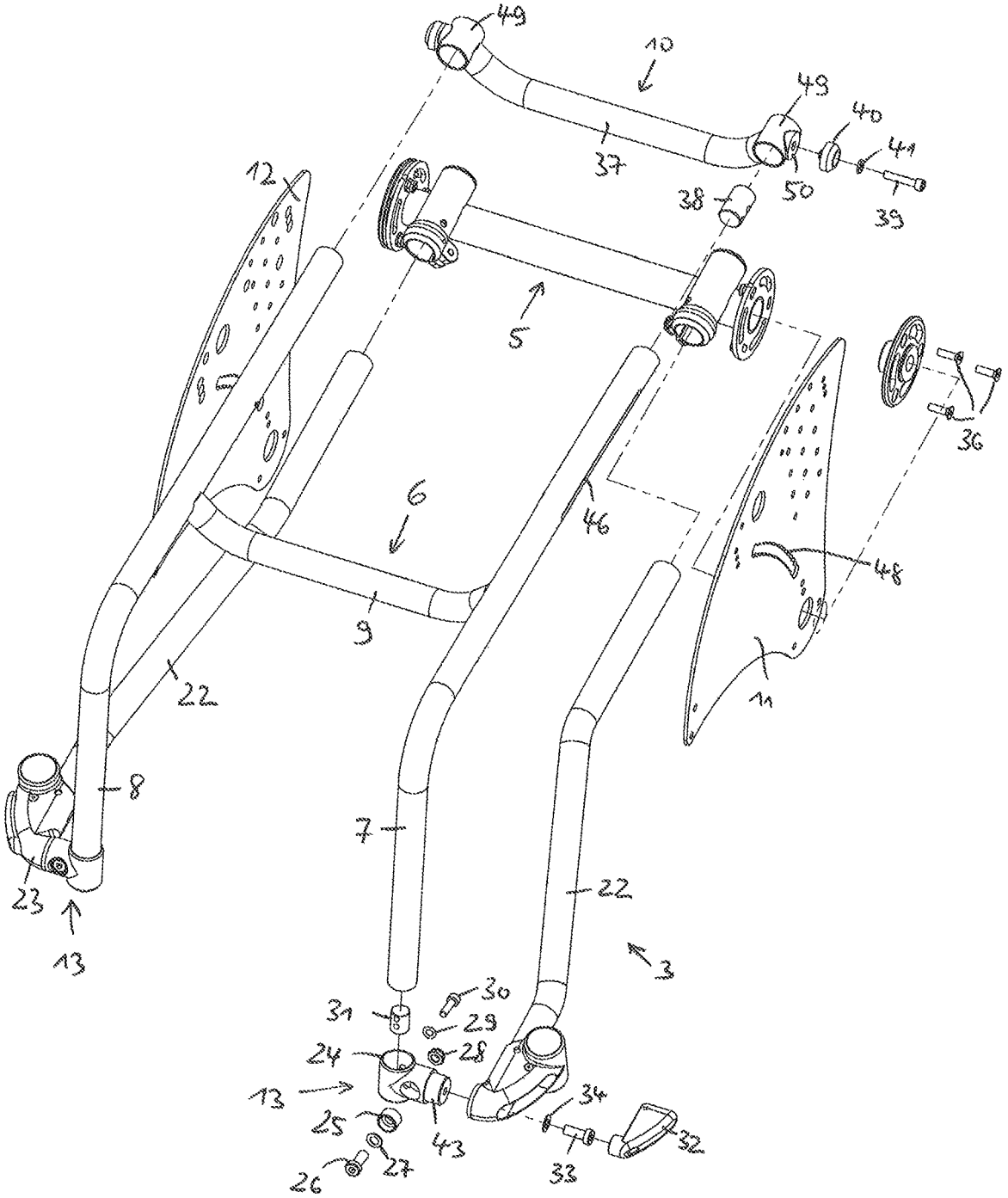
FIG. 5 shows in a three-dimensional view according to FIG. 2, the arrangement therein but in an exploded view.
Figure 6:
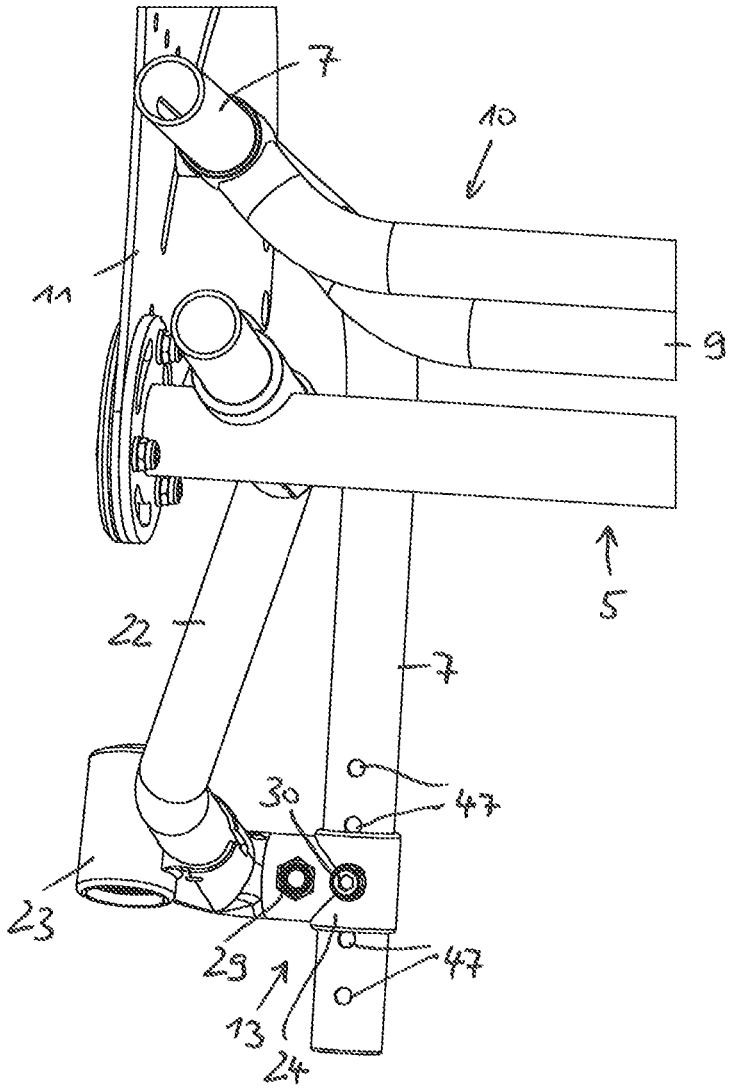
FIG. 6 shows in a view a partial region of the wheelchair in the region of the attachment of the base frame and seat-foot support frame.
Figure 7:
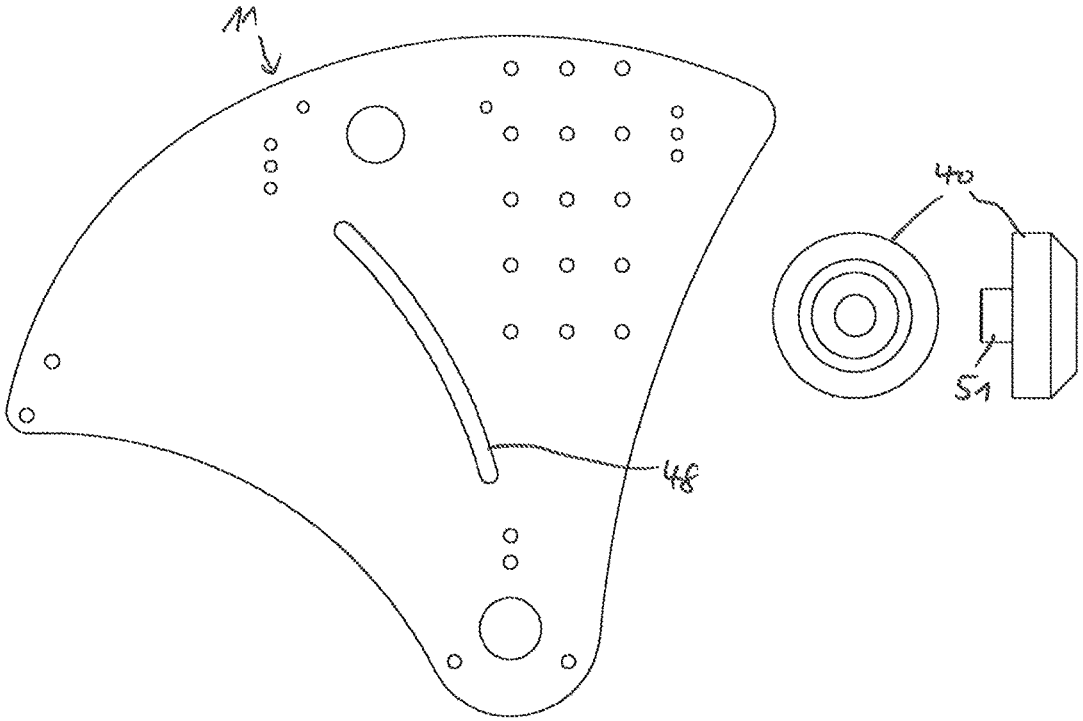
FIG. 7 shows in a view an embodiment of the respective frame connector with slots without increments.

In the embodiment described (FIG. 3) the left-hand side strut 3 and the right-hand side strut 4 in each case consist of a strut tube 22 and a multifunction part 23 which in each case is fixedly connected to the strut tube 22 (for example welded). The multifunction part 23 substantially fulfills three functions:

receiving bearing seats for the steering fork 52 of a front wheel 17 receiving an impact protection device 32 (FIG. 5)

bearing the coupling unit 13

For the rotatable and positive bearing of the coupling units 13 the multifunction parts 23, at their side oriented toward the sagittal plane, in each case have a blind hole 42 (FIG. 3) which corresponds to a stub attachment 43 (FIG. 5) of the respective coupling piece 24. The axle of the blind hole is perpendicular to the sagittal plane. The coupling units 13 in each case are screwed by means of connecting elements 33 and 34 to the side struts 3 and 4 on the multifunction parts 23.

The left-hand and right-hand struts 7 and 8 of the seat-foot support frame 6 are received in a linearly adjustable manner with their foot support tube segments 44 in the coupling piece 24 and by means of securing elements 29, 30 and 31 in the coupling piece 24 fixed in a bore 47 (FIG. 6) corresponding to the desired seat height. The bores 47 require a stepped seat height variation. Also conceivable, however, is a stepless adjustment by, for example, clamping.

By means of the clamping element 25 and the connecting elements 26, 27 and 28, the coupling units 13 may be fastened non-positively to the foot support tube segments 44 of the left-hand and right-hand struts 7 and 8. This permits the accurate alignment of the coupling units 13 to the bores 47 and simplifies the positioning and mounting of the connecting elements 29, 30 and 31.

After the securing of the seat angle and seat height as described above, by means of frame connectors 11 and 12 a stable connection may be produced between the base frame 2 and the seat-foot support frame 6 in each case in the rear region thereof. This may be implemented in many different ways, for example by telescopic tubular connections or by struts which may be fastened with different spacings between, and relative to, the base frame 2 and the seat-foot support frame 6.

In a preferred embodiment, the frame connectors 11 and 12 are configured as plates which are fixedly screwed to the rear axle 5 by means of connecting elements 36. These frame connectors 11 and 12 may consist of a different material from the rear axle 5, for example of carbon. The frame connectors 11 and 12 extend with their upper contour preferably approximately concentrically to the rear wheels 16. The frame connectors may serve per se at the same time as clothes protection relative to the spoke wheels and receive a backrest frame construction. The frame connectors have in each case a slot 48 (in this case slightly curved) which extends from slightly above the rear axle 5 obliquely upwardly to the front. These slots 48 correspond to slots 46 in the seat tube segments 45 of the left-hand and right-hand struts 7 and 8 and form therewith, depending on the adjustment of the seat angle, seat height and wheelbase (position of the rear axle 5), a point of intersection at different positions relative to both slots. By means of clamping blocks 38 which are guided in the region and along the slots 46 in the seat tube segments 45 of the left-hand and right-hand struts 7 and 8, and the clamping disks 40 as well as the connecting elements 39 and 41, the left-hand strut 7 is clamped to the frame connector 11 and the right-hand strut 8 is clamped to the frame connector 12, and thus ultimately the entire frame structure is provided with stability.

In each case a camber adapter 35 (in the present case 6°) is connected to the rear axle 5 and the frame connector 11 and/or to the rear axle 5 and the frame connector 12 in the fixed position—without the requirement of re-adjusting the camber in the case of seat angle adjustment.

In a preferred embodiment, an additional transverse strut 10 consisting of the transverse strut tube 37 and the transverse strut couplings 49 is installed. The additional transverse strut is received by the left-hand and right-hand strut 7 and 8 in the transverse strut couplings 49 and the transverse bores 50 of the transverse strut couplings 49 are brought into congruence with the respective points of intersection of the slots 46 and 48. In this position, the transverse strut 10 together with the frame connectors 11 and 12 and the left-hand and right-hand struts 7 and 8 are additionally and at the same time clamped by means of clamping blocks 38, clamping disks 40 and the connecting elements 39 and 41.

The slots 48 may be configured in very different embodiments. A preferred object, however, is that when adjusting the seat angle and the seat height the clamping blocks 38 cover a path which is as wide as possible, both relative to the slots 46 and the slots 48 and thus produce the highest possible level of friction resistance.

Figure 8:
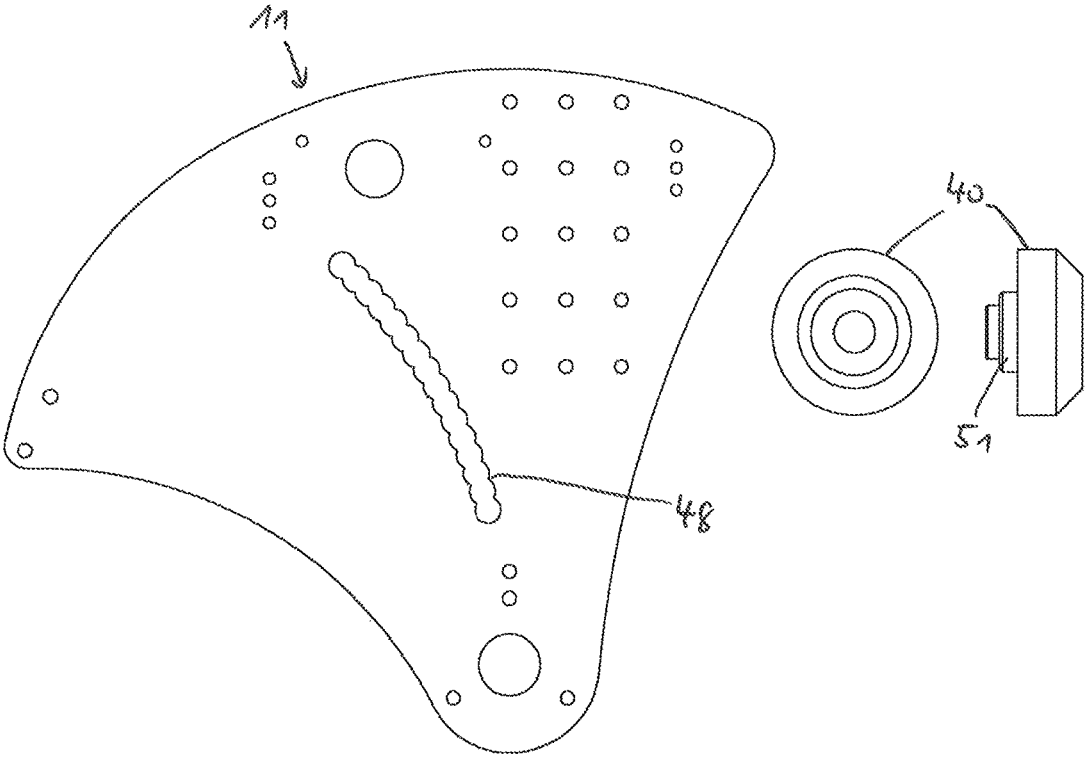
FIG. 8 shows in a view an embodiment of the respective frame connector with slots with increments.

In a particular embodiment the slots 48 have increments (FIG. 8). This permits, on the one hand, the exact equal adjustment on the left-hand and right-hand side and, on the other hand, in addition to the flux of force also a secure positive connection between the frame connectors 11 and 12 and the clamping disks 40. The slot without increments (FIG. 7) has the advantage of a stepless angular adjustment. The shaft shoulders 51 of the clamping disks 40 are adapted to the respectively associated type of slot.

FIGS. 9 to 13 show a rigid frame according to the invention in an adaptable boxframe design from the left-hand side. In this case the left-hand frame connector 11 is masked, in order to be able to show more clearly the relative position of the slots 46 and 48 and the transverse strut 10 (and thus the clamping blocks 38).

Figure 9:
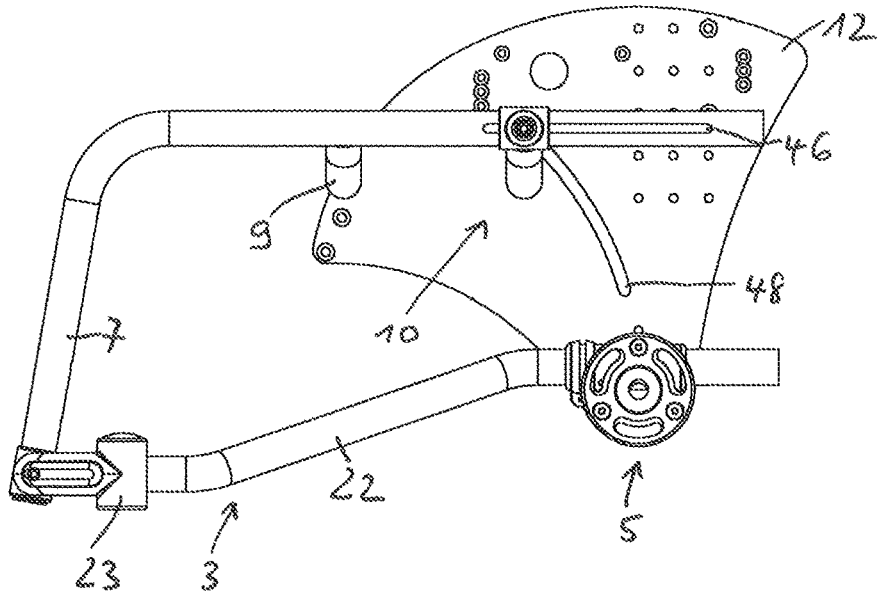
FIG. 9 shows the rigid frame viewed from the left-hand side, with the left-hand frame connector masked, illustrated when adjusting the rigid frame to a seat angle of 0° relative to the road.
Figure 10:
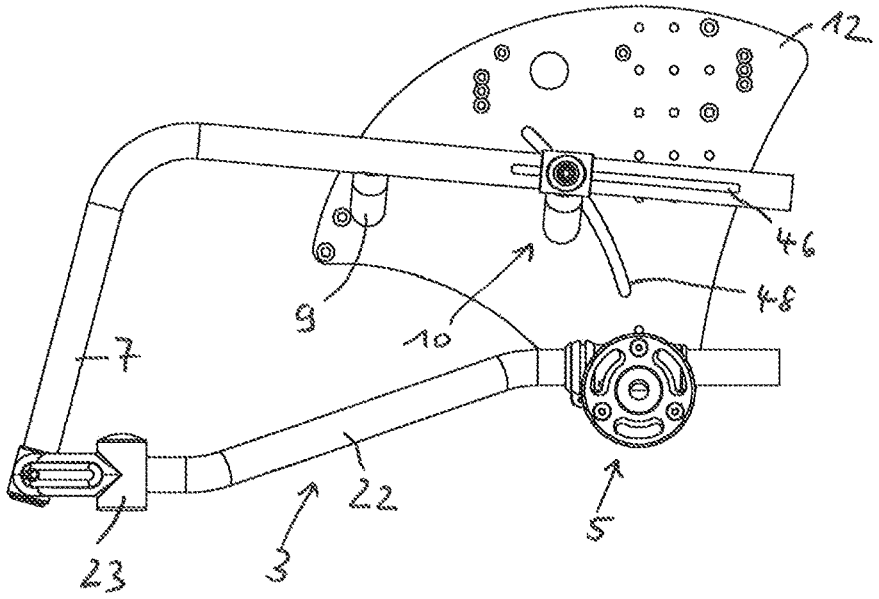
FIG. 10 shows a view according to FIG. 9 illustrated for a seat angle of about 5° relative to the road.

FIG. 9 shows the rigid frame with a seat angle of 0° relative to the road, and FIG. 10 with a seat angle of about 5°.

Figure 11:
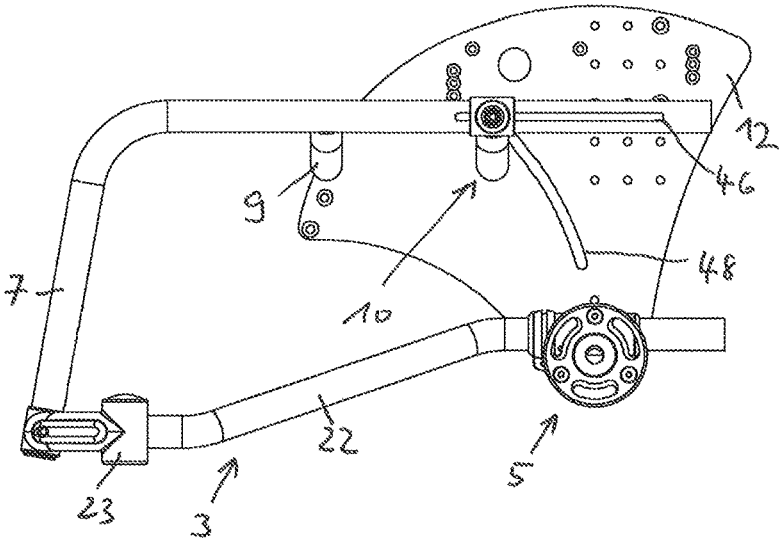
FIG. 11 shows the rigid frame with an adjustment of the maximum seat height with a seat angle of 0° relative to the road.
Figure 12:
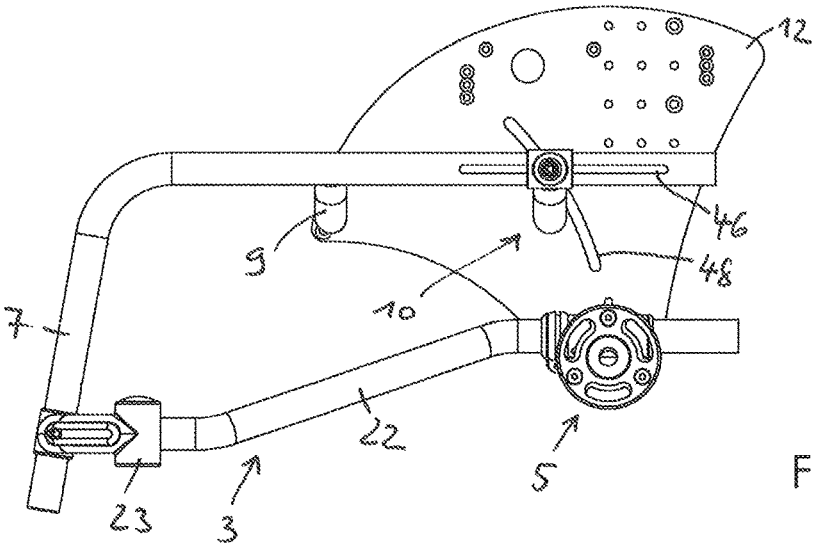
FIG. 12 shows the rigid frame according to FIG. 11 with an average seat height and a seat angle of 0° relative to the road.
Figure 13:
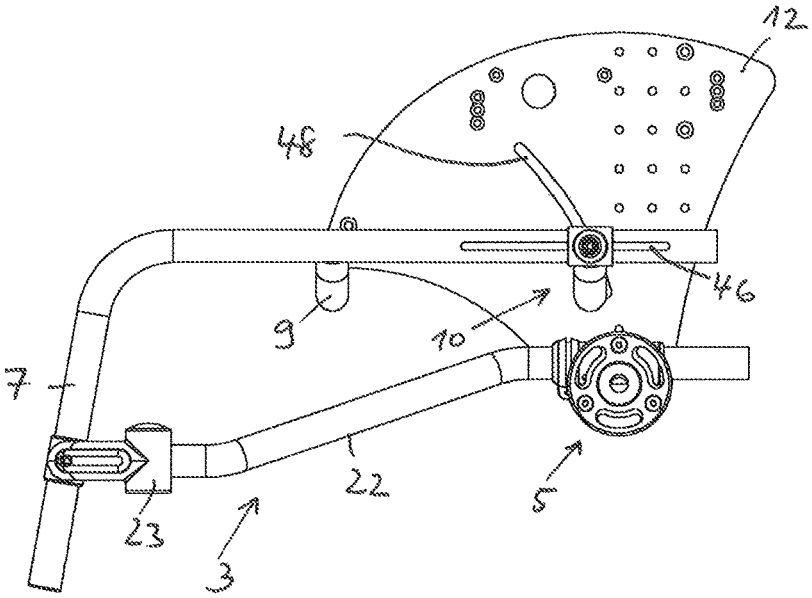
FIG. 13 shows the rigid frame according to FIG. 11 with a lowest seat height and a seat angle of 0° relative to the road.

FIG. 11 shows the rigid frame with the adjustment of the maximum seat height, FIG. 12 with an average seat height and FIG. 13 with the lowest seat height; in all cases with a seat angle of 0° relative to the road.

That which is claimed is:

1. A rigid frame wheelchair of a box frame design, comprising:

a base frame having a rear axle for receiving rear wheels and a left-hand side strut and a right-hand side strut for receiving steering wheels in front regions of the left-hand and the right-hand side struts;

an L-shaped seat-foot support frame having an L-shaped left-hand strut and an L-shaped right-hand strut, wherein each L-shaped strut has a seat tube segment and a foot support tube segment, and wherein the seat-foot support frame further has a transverse strut that connects the L-shaped struts;

two coupling units that connect together in an articulated manner the base frame in a left-hand front region and a right-hand front region to the seat-foot support frame in a region of the left-hand and the right-hand foot support tube segments about an axis vertically to a sagittal plane for an angular adjustment, and wherein the foot support tube segments are adjustably mounted for a seat height adjustment; and a left-hand frame connector and a right-hand frame connector, wherein the frame connectors fixedly connect together the base frame and the seat tube segments, and wherein the seat tube segments are configured to be connected to the frame connectors in various positions, and wherein each frame connector has a slot arranged inclined to an adjacent slot of the corresponding seat tube segment, and wherein securing means for securing the frame connector and the seat tube segment penetrate the slots for securing the frame connector and the corresponding seat tube segment in various positions.

2. The wheelchair as claimed in claim 1, wherein the foot support tube segments are adjustable in a stepless manner or in a stepped manner in the coupling units.

3. The wheelchair as claimed in claim 1, wherein each foot support tube segment is displaceably mounted in a coupling piece of the coupling unit configured as a sleeve and is configured to be secured relative to the coupling piece by a clamping means.

4. The wheelchair as claimed in claim 1, wherein each side strut has a strut tube and a multifunction part connected fixedly thereto, and wherein each multifunction part is configured for receiving bearing seats for a steering fork of a front wheel and for bearing the coupling unit and is further configured for receiving an impact protection device.

5. The wheelchair as claimed in claim 1, wherein the left-hand frame connector and the right-hand frame connector fixedly connect together the base frame and the seat tube segments in a respective rear region thereof.

6. The wheelchair as claimed in claim 1, wherein the seat tube segments in a rear region thereof movably receive a further transverse strut, and wherein the further transverse strut is connected in a region of the ends remote therefrom to the frame connectors.

7. The wheelchair as claimed in claim 1, wherein each frame connector is configured as a plate arranged parallel to the sagittal plane.

8. The wheelchair as claimed in claim 1, wherein each frame connector is fixedly connected to the rear axle by at least one connecting element.

9. The wheelchair as claimed in claim 1, wherein the slot of the frame connector extends from above the rear axle obliquely upwardly to the front, and wherein the slot of the seat tube segment extends in the axial direction of the seat tube segment.

10. The wheelchair as claimed in claim 1, wherein the slot of the frame connector is slightly curved and the slot of the seat tube segment is arranged in a linear manner extending in the axial direction of the seat tube segment.

11. The wheelchair as claimed in claim 1, wherein the frame connectors and the seat tube segments are configured to be connected together steplessly or in defined adjustment intervals.

12. The wheelchair as claimed in claim 1, wherein the rear axle is displaceable on the side struts for the adjustability of a wheelbase of the wheelchair and is configured to be secured relative to the side struts.

* * * * *